United States Patent [19]

Beller

[11] Patent Number: 4,979,413

[45] Date of Patent: Dec. 25, 1990

[54] DOUBLE WELT TRIMMER

[76] Inventor: W. K. Beller, 8129 E. 16th St., Apt. 120, Tulsa, Okla. 74112

[21] Appl. No.: 350,639

[22] Filed: May 11, 1989

[51] Int. Cl.[5] ..... B26D 1/02

[52] U.S. Cl. ..... 83/444; 83/446; 83/856; 83/914

[58] Field of Search ..... 83/568, 856, 857, 858, 83/569, 648, 440, 438, 443, 444, 445, 446, 447, 448, 449, 450, 914, 582; 409/297, 298

[56] References Cited

U.S. PATENT DOCUMENTS

| | | | |
|---|---|---|---|
| 441,532 | 11/1890 | Bruce | 83/450 |
| 1,206,946 | 12/1916 | Tscherne | 83/449 X |
| 1,306,992 | 6/1919 | Barrile et al. | 83/447 X |
| 1,753,710 | 4/1930 | Mayer | 83/176 |
| 3,069,951 | 12/1962 | Bares | 83/562 X |
| 3,388,626 | 6/1968 | Larson | 83/914 X |
| 3,456,639 | 7/1969 | Steinbacher | 83/914 X |
| 3,796,118 | 3/1974 | Teed | 83/448 X |
| 4,130,040 | 12/1978 | Donnelly, Sr. et al. | 83/568 X |
| 4,312,255 | 1/1982 | Holmström | 83/582 |

FOREIGN PATENT DOCUMENTS

| | | | |
|---|---|---|---|
| 365271 | 3/1973 | U.S.S.R. | 83/914 |

*Primary Examiner*—Frank T. Yost
*Assistant Examiner*—Rinaldi Rada
*Attorney, Agent, or Firm*—William S. Dorman

[57] ABSTRACT

A double welt trimmer for removing the excess edge from a double welt comprising a housing, a passageway through the housing to permit the passage of the double welt therethrough, a cutter assembly mounted on the housing and having a cutting blade associated therewith, and being disposed immediately above the passageway so as to cut the excess edge from the double welt when the latter is pulled through the passageway. In one form of the invention, a piece of sponge rubber or plastic material urges a slotted block containing the passageway towards the cutter assembly. The welt material is pulled through the slot in the block and an aligned notch in the housing. In another form of the invention, the cutter assembly is mounted on the top of the housing by means of a pair of bolts which pass into the interior of the housing. The double welt material is pulled through a slot in the housing under the cutter sub-assembly. Springs mounted on the bolts urge the cutter assembly downwardly into engagement with the double welt material as it is pulled through the slot.

5 Claims, 5 Drawing Sheets

DOUBLE WELT TRIMMER

Background of the Invention

1. Field of the Invention

The present invention relates to a double welt strip that is placed on furniture and more particularly, it relates to a device for removing the excess edge from the strip prior to its application to the furniture.

2. The Prior Art

A double welt strip (sometimes merely referred to as "double welt") is used on furniture to cover staples and tacks. The double welt is generally applied by gluing strips thereof to the fabric over the staples or tacks. The upholsterer generally makes his own double welt by covering a pair of parallel welts with a strip of fabric which is the same as the fabric on the furniture or compatible therewith. The two pieces of parallel welt are wrapped with the fabric and passed through a sewing machine; however, the resulting product has an excess edge thereon.

The need for removing the selvage or excess edge from the double welt has long since been recognized. However, the customary method of accomplishing this is with a pair of scissors, which is a tedious and time consuming operation.

A patentability search was conducted on the present invention and the following listed U.S. Patents were uncovered in that search.

| U.S. Pat. No. | Patentee | Date |
|---|---|---|
| 45,620 | C. Lemon | 12/27/1864 |
| 255,638 | A. C. Krueger | 3/28/1882 |
| 669,066 | B. M. Allen | 3/05/01 |
| 1,753,710 | C. A. Mayer | 4/08/30 |
| 1,898,647 | E. C. Teuscher | 2/21/33 |
| 3,103,319 | S. H. Floyd et al | 9/10/63 |
| 3,712,344 | Kovacec | 1/23/73 |
| 4,175,460 | McPhail | 11/27/79 |

None of the above patents is deemed sufficiently close to warrant any comment.

SUMMARY OF THE INVENTION

A double welt trimmer for removing the excess edge from a double welt strip comprising a housing, a passageway through the housing to permit the passage of the double welt therethrough, a cutter assembly mounted on the housing and having a cutting blade associated therewith, and being disposed immediately above the passageway so as to cut the excess edge from the double welt when the latter is pulled through the passageway and resilient means mounted in the housing for resiliently urging the cutter assembly and the strip relatively towards each other. In one form of the invention, the resilient means comprises a piece of sponge rubber or plastic material which urges a slotted block towards the cutter assembly. The welt material is pulled through the slot in the block and an aligned notch in the housing. In another form of the invention, the cutter assembly is mounted on the top of the housing by means of a pair of bolts which pass into the interior of the housing. The double welt material is pulled through a slot in the housing under the cutter sub-assembly. Springs mounted on the bolts urge the cutter assembly downwardly into engagement with the double welt material as it is pulled through the slot.

DETAILED DESCRIPTION OF THE PREFERRED EMBODIMENTS

Figure 5:
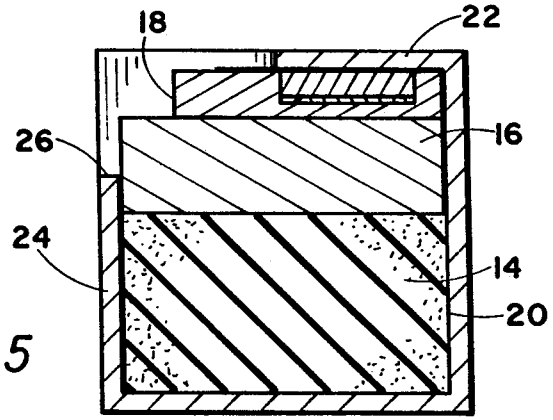
FIG. 5 is a transverse, cross sectional view taken along section line 5—5 of FIG. 4.
Figure 6:
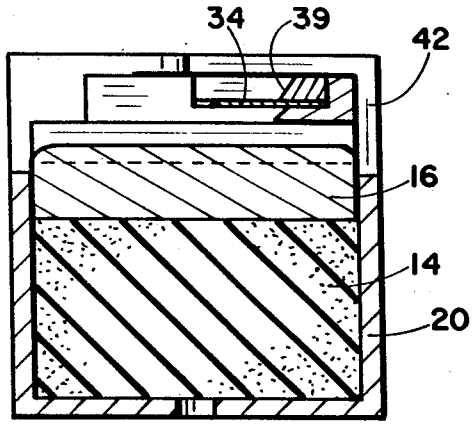
FIG. 6 is a transverse, cross sectional view taken along section line 6—6 of FIG. 4.
Figure 1:
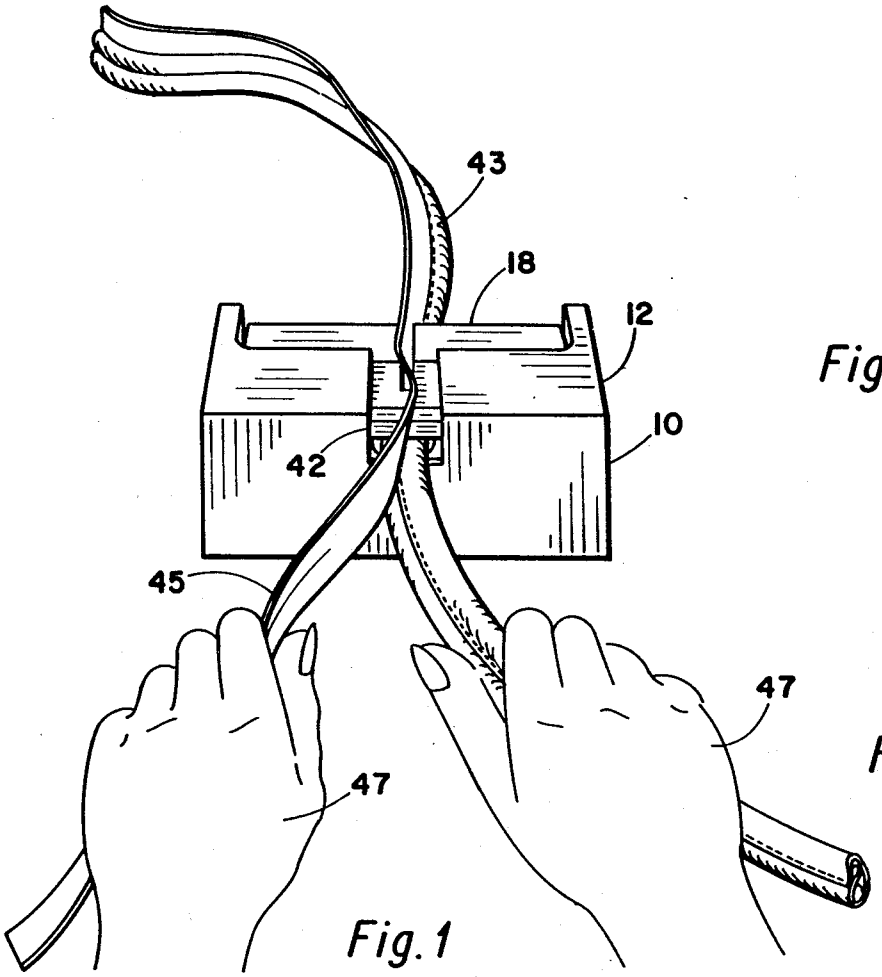
FIG. 1 is a perspective view of one embodiment of the invention showing the hands of a person pulling a piece of double welt upholstery material through the trimmer of the present invention.
Figure 2:
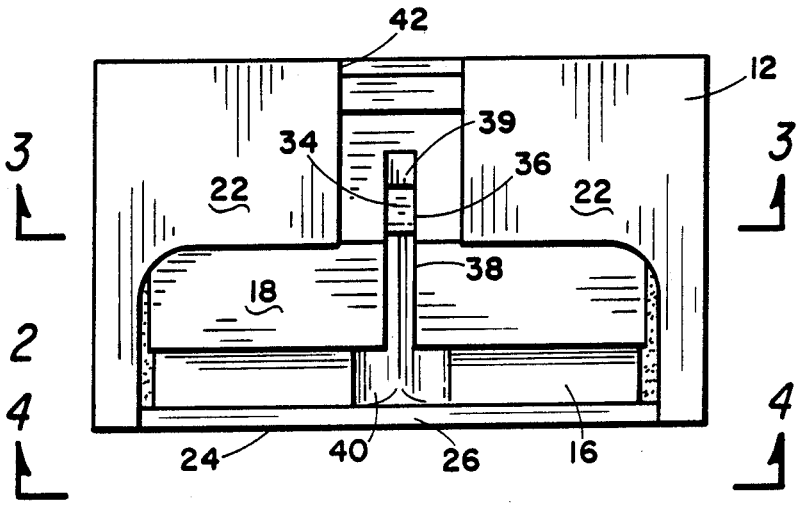
FIG. 2 is a plan view of the embodiment shown in FIG. 1.
Figure 3:
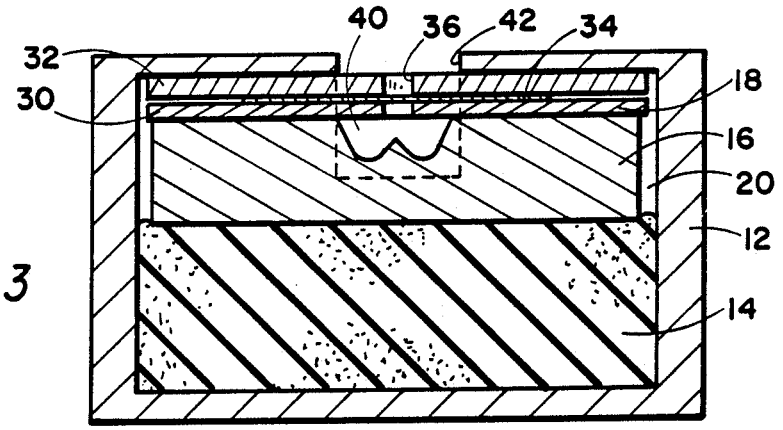
FIG. 3 is a sectional view taken along section line 3—3, FIG. 2.
Figure 4:
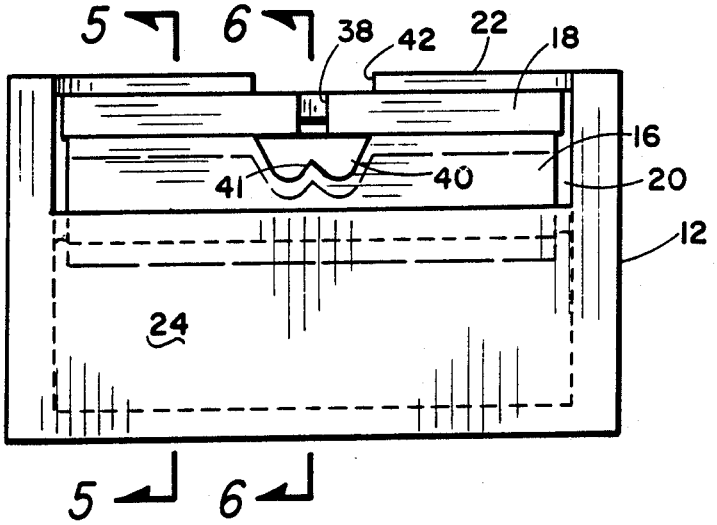
FIG. 4 is a front elevation as it would appear looking along line 4—4 of FIG. 2.

Referring to the drawings in detail, FIGS. 1 through 10 show a double welt trimmer 10 consisting of four main components: (a) a rectangular housing 12 containing (b) a rectangular piece of sponge material 14 acting as a spring; (c) an intermediate block 16 supported within the housing above the sponge 14 and (d) a flat, matellic cutter sub-assembly 18 supported in the housing above the block 16.

Figure 7:
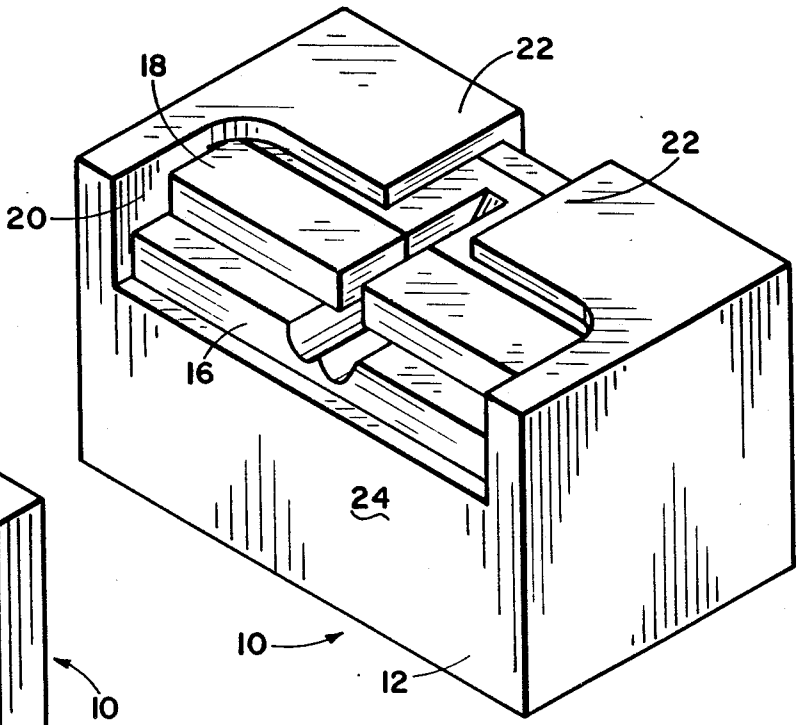
FIG. 7 is a perspective view looking down at the front and right sides of the embodiment shown in FIGS. 1–6.
Figure 8:
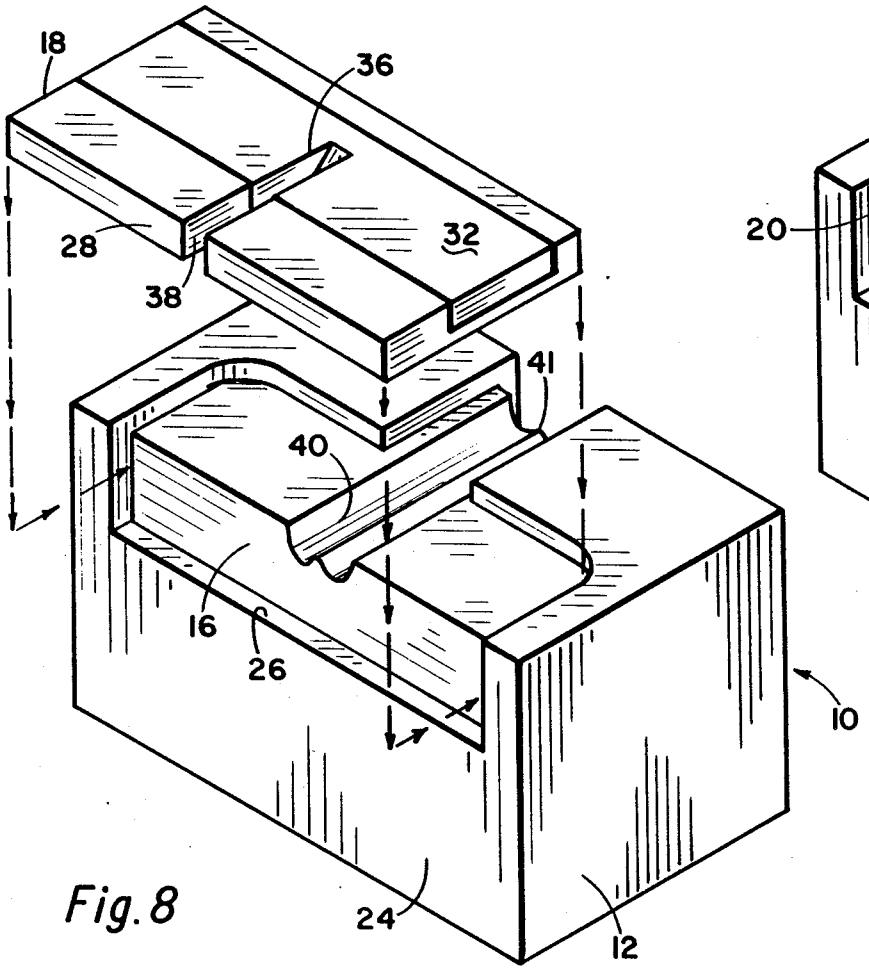
FIG. 8 is an exploded view similar to FIG. 7, but showing the cutter sub-assembly in a position removed and indicating the method of introducing the cutter sub-assembly into the housing sub-assembly.

The housing 12 is essentially rectangular in shape and is provided with a central rectangular cavity 20 in which the sponge 14, the block 16 and the cutter sub-assembly 18 are received as best shown in FIGS. 7 and 8. The upper portion of the housing is provided with a pair of forwardly projectng flanges 22 which overcharge the cavity 20. The housing is also provided with a front vertical plate 24 whose upper edge 26 is spaced below the flanges 22. When the sponge block 14 is placed in the cavity 20, the intermediate block 16 is inserted into the cavity 20 over the sponge and under the flanges 22. The sponge 14 will now be pushing the upper surface of the block 16 against the under sides of the flanges 22. Now, the block 16 is pushed downwardly against the spring action of the sponge 14 and the cutter sub-assembly 18 is inserted between the top of the block and the bottoms of the flanges 22. The cutter sub-assembly 18 is now snugly held under the flanges 22.

Figure 9:
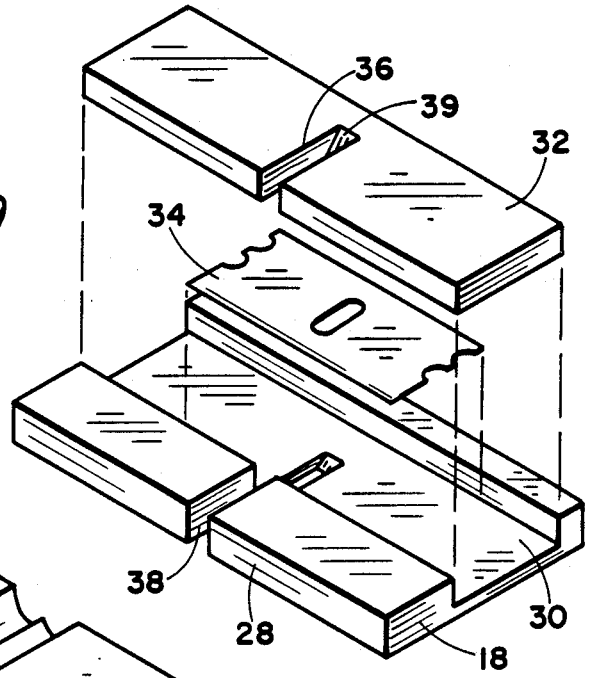
FIG. 9 is an exploded view of the cutter sub-assembly.
Figure 10:
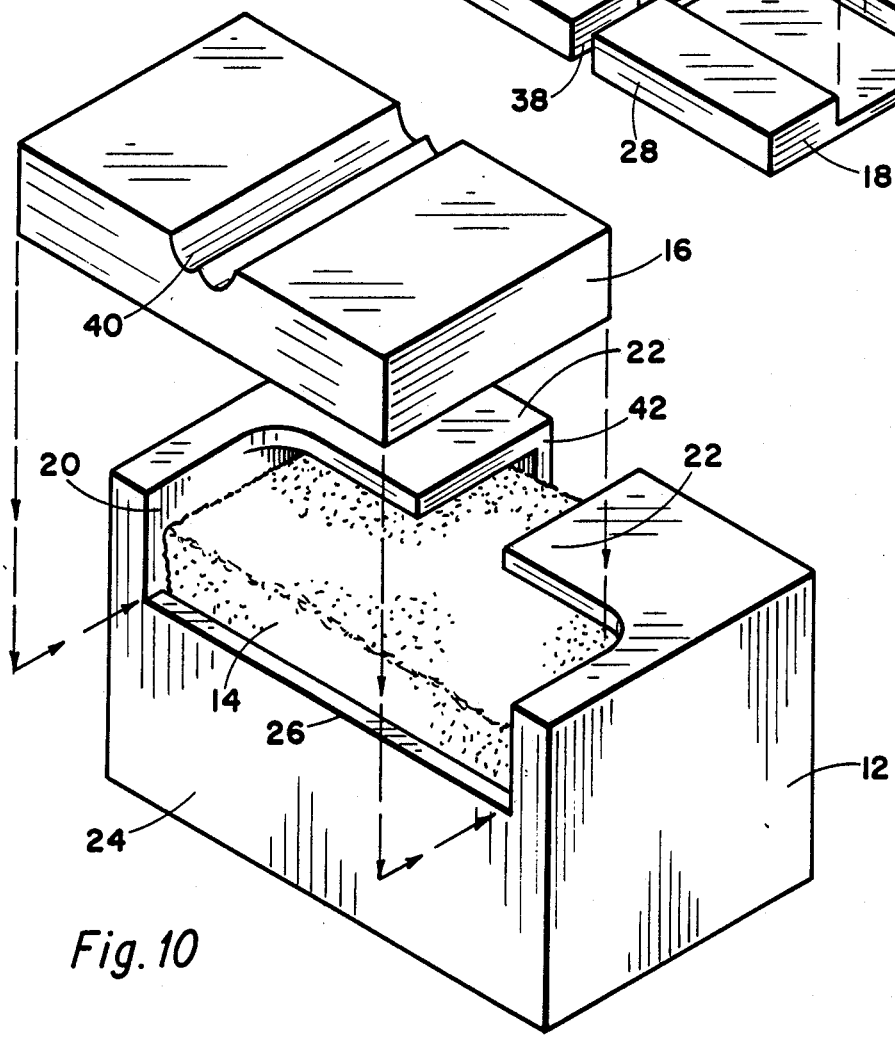
FIG. 10 is an exploded view of the housing sub-assembly showing the block removed from above the resilient sponge.

As best shown in FIG. 9, the cutter sub-assembly 18 consists of a lower plate 28 having a rectangular recess 30. An upper rectangular plate 32 is adapted to be received in the recess 30 of the lower plate. A razor blade 34 is adapted to be received between the plate 32 and the plate 30. The upper plate is provided with a notch 36 and the lower plate is provided with a notch 38. The upper portion of the notch 36 is upwardly and rearwardly inclined as shown at 39. When the plate 32 is disposed in the notch 30 with the razor blade sandwiched between, the notch 36 is in alignment with the notch 30 and the forward cutting edge of the razor blade is adjacent the forward portion of the recess 30.

The block 16 is provided with a groove or recess 40 which is disposed beneath the notch 38 when the parts are in the assembled condition. The rear of the housing 12 is provided with a notch 42 between the two flanges 22. The notch 42, the groove 40 in the block 16 and the notch 38 together with the notch 36 are all in alignment with each other. If desired, a vertical ridge 41 can be provided in the center of the notch 40 to assist in guiding the double welt material 43 through the device. It is a simple matter to feed one end of the material 43 through the front end (as it appears in FIGS. 2 and 4) of the groove 40 after cutting a portion of the excess strip 45 with a pair of scissors. Thereafter, a person can simply pull with his hands 47, and the razor blade will cut the remainder of the strip 45. If desired, the device 10 can be bolted to a table (not shown).

Figure 11:
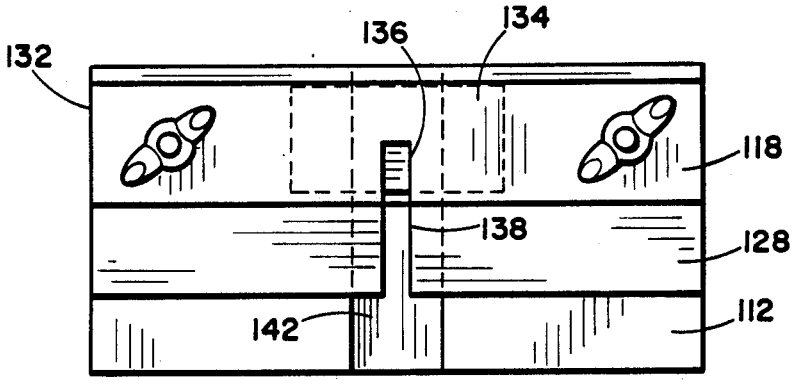
FIG. 11 is a plan view similar to FIG. 2 showing a modified form of the present invention.
Figure 12:
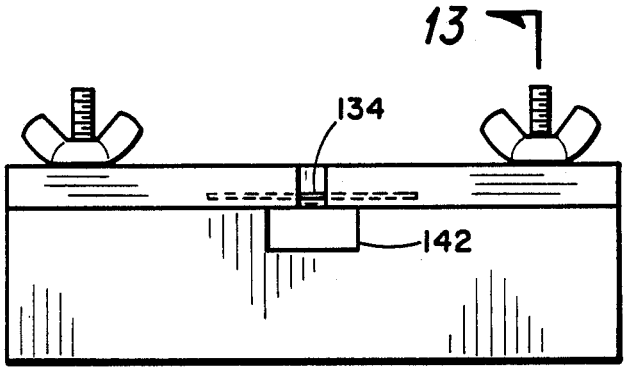
FIG. 12 is a front elevation of the embodiment shown in FIG 11.
Figure 13:
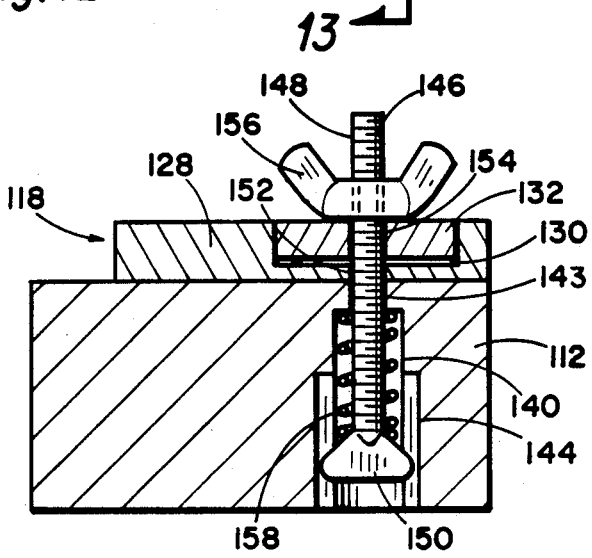
FIG. 13 is a transverse, cross sectional view taken along section line 13—13 of FIG. 12.

In the embodiment shown in FIGS. 11, 12 and 13, the sponge block 14 and intermediate block 16 have been eliminated. The device shown includes a housing 112 having a central groove or notch 142. The cutter sub-assembly 118 is similar to the cutter sub-assembly 18 previously described and is provided with corresponding portions including a lower flat plate 128 and an upper flat plate 132 received in a groove 130 in the lower flat plate 128. A razor blade 134 is also sandwiched between the two plates 132 and 128. The upper plate is provided with a notch 136 which is essentially the same as the notch 36 and the lower plate is provided with a notch 138 which is essentially the same as the notch 38 previously described. The block 112 is provided with a pair of vertical bores 140 (only one of which is shown in FIG. 13). Each bore 140 connects at its upper end with a smaller hole 143 and with an enlarged bore 144 at its lower end. A screw 146 having an upper threaded end 148 and a lower enlarged end 150 is adapted to pass through the hole 143 and through corresponding holes 152 and 154 in the plates 128 and 132, respectively. A wing nut 156 is threadedly received on the upper end of the screw 146 and a spring 158 is received on the lower end of the screw above the enlarged end 150. When the material 43 is pulled through the notch 142, the cutter assembly 118 will bear against the double welt, but can raise upwardly against the action of the spring 158 to accommodate the thickness of the material.

Whereas the present invention has been described in particular relation to the drawings attached hereto, it should be understood that other and further modification, apart from those shown or suggest herein, may be made within the spirit and scope of the invention.

What is claimed is:

1. A double welt trimmer for removing the excess edge from a double welt strip comprising a rectangular housing having a rectangular cavity therein, a rectangular sponge received in the cavity, an intermediate block received in the cavity above the sponge, a flat cutter assembly supported in teh cavity above the intermediate block, the housing having an upper portion which includes a pair of spaced forwardly projecting flanges overlaying the cavity, the sponge acting as a spring to urge the cutter assembly against the undersides of the flanges, the spacing between the two flanges constituting a notch at the rear of the housing, the intermediate block having a central recess extending from the front of the housing to the rear thereof in alignment with the notch in the housing, the recess constituting a passageway for passing a strip of double welt material therethrough, the cutter assembly comprising a lower plate having a rectangular recess therein and an upper plate received in the rectangular recess, a razor blade being disposed between the upper plate and the lower plate and having its cutting edge facing the front side of the housing, the upper plate and the lower plate having aligned notches which extend to and beyond the cutting edge of the razor blade towards the rear of the housing, the notches in the plates being in alignment with the recess in the block and the notch in the housing.

2. A double welt trimmer for removing the excess edge from a double welt strip comprising a housing having a central groove therein extending from a front side of said housing to a rear side thereof and constituting a passageway to permit the passage of double welt material therethrough, a cutter assembly mounted on the top of said housing, the cutter assembly comprising a lower plate having a rectangular recess therein and an upper plate received in the rectangular recess, a razor blade being disposed between the upper plate and the lower plate and having its cutting edge facing the front side of the housing, the upper plate and the lower plate having aligned notches which extend to and beyond the cutting edge of the razor blade towards the rear of the housing, the notches in the plates being in alignment with the groove in the housing, the cutter assembly being mounted on the top of the housing by means of a pair of bolts which pass into the interior of the housing, and springs mounted on the bolts for urging the cutter assembly downwardly towards the housing.

3. A double welt trimmer for removing the excess edge from a double welt strip comprising a housing, a passageway through the housing to permit the passage of the double welt therethrough, a cutter assembly mounted on the housing and having a cutting blade associated therewith, and being disposed immediately above the passageway so as to cut the excess edge from the double welt when the latter is pulled through the passageway and resilient means mounted in the housing for resiliently urging the cutter assembly and the strip relatively towards each other.

4. A double welt trimmer as set forth in claim 3 wherein the resilient means comprises a piece of sponge rubber received within the housing beneath the cutter assembly, a slotted block received in the housing between the sponge rubber and the cutter assembly, the slotted block having a slot therein constituting said passageway, the sponge rubber resiliently urging the slotted block towards the cutter assembly.

5. A double welt trimmer as set forth in claim 3 wherein the cutter assembly is mounted on the top of the housing by means of a pair of bolts which pass into the interior of the housing, springs mounted on the bolts for urging the cutter assembly downwardly towards the housing, the housing having a slot therein beneath the cutter assembly, the slot constituting said passageway.

* * * * *